US006820560B1

(12) United States Patent
Romppanen

(10) Patent No.: US 6,820,560 B1
(45) Date of Patent: Nov. 23, 2004

(54) NON-KILLING CARTRIDGE

(76) Inventor: Juha Romppanen, Pengertie 9, FIN-17200 Vääksy (FI)

( * ) Notice: Subject to any disclaimer, the term of this patent is extended or adjusted under 35 U.S.C. 154(b) by 0 days.

(21) Appl. No.: 09/672,898

(22) Filed: Sep. 29, 2000

(30) Foreign Application Priority Data

Sep. 30, 1999 (IE) ..... 19992108

(51) Int. Cl.[7] ..... F42B 10/00
(52) U.S. Cl. ..... 102/502; 102/444
(58) Field of Search ..... 102/502, 438, 102/419, 444

(56) References Cited

U.S. PATENT DOCUMENTS

| | | | | | |
|---|---|---|---|---|---|
| 931,723 | A | * | 8/1909 | Bird | 102/449 |
| 3,074,344 | A | * | 1/1963 | Devaux | 102/42 |
| 3,085,510 | A | * | 4/1963 | Campbell | 102/42 |
| 3,609,854 | A | | 10/1971 | Hasui | |
| 3,710,720 | A | * | 1/1973 | Mawhinney | 102/391 |
| 3,762,329 | A | * | 10/1973 | Mawhinney | 102/448 |
| 3,815,502 | A | * | 6/1974 | Mawhinney | 102/449 |
| 3,951,070 | A | * | 4/1976 | Flatau et al. | 102/502 |
| 3,952,662 | A | * | 4/1976 | Greenless | 102/92.7 |
| 3,956,844 | A | * | 5/1976 | Misevich et al. | 102/503 |
| 3,982,489 | A | | 9/1976 | Flatau et al. | |
| 4,098,193 | A | * | 7/1978 | Schroeder | 102/92 |
| 4,154,012 | A | * | 5/1979 | Miller | 42/1 |
| 4,190,476 | A | * | 2/1980 | Flatau et al. | 156/218 |
| 4,366,015 | A | * | 12/1982 | Murray | 156/185 |
| 4,664,034 | A | * | 5/1987 | Christian | 102/439 |
| 4,966,365 | A | * | 10/1990 | Winston | 482/105 |
| 5,165,694 | A | * | 11/1992 | Kraushaar | 273/343 |
| 5,225,628 | A | * | 7/1993 | Heiny | 102/438 |
| 5,315,932 | A | * | 5/1994 | Bertram | 102/438 |
| 5,450,795 | A | * | 9/1995 | Adelman | 102/444 |
| 5,492,320 | A | * | 2/1996 | Hoffman et al. | 473/594 |
| 5,655,777 | A | * | 8/1997 | Neading et al. | 473/594 |
| 5,691,501 | A | | 11/1997 | Gilbert | |
| 6,145,441 | A | * | 11/2000 | Woodall et al. | 102/502 |
| 6,164,209 | A | * | 12/2000 | Best et al. | 102/450 |
| 6,202,562 | B1 | * | 3/2001 | Brunn et al. | 102/502 |
| 6,298,788 | B1 | * | 10/2001 | Woods et al. | 102/502 |
| 6,302,028 | B1 | * | 10/2001 | Guillot-Ulmann et al. | 102/444 |
| 6,371,028 | B2 | * | 4/2002 | Saxby | 102/502 |
| 6,374,742 | B1 | * | 4/2002 | Brunn et al. | 102/444 |

FOREIGN PATENT DOCUMENTS

| | | |
|---|---|---|
| DE | 28 44 675 | 4/1980 |
| FR | 2 789 484 | 8/2000 |
| WO | 98 54538 | 12/1998 |

* cited by examiner

*Primary Examiner*—Jack Keith
*Assistant Examiner*—M. Thomson
(74) *Attorney, Agent, or Firm*—Oblon, Spivak, McClelland, Maier & Neustadt, P.C.

(57) ABSTRACT

Non-killing cartridge manufactured of cloth and metal shots to be used as forcible measures and fired with a firearm. The metal shots are arranged into shot bags, and the cartridge may be packed into a shell of a conventional firearm. When firing with a firearm, the cartridge first flies one meter in the packed form, whereafter it opens. Upon hitting, its area is sufficiently big so that no penetration occurs.

20 Claims, 3 Drawing Sheets

NON-KILLING CARTRIDGE

BACKGROUND OF THE INVENTION

1. Field of the Invention

The invention relates to a non-killing cartridge packed in a shell and manufactured of cloth and metal shots, intended to be fired with a firearm and used as forcible measures.

2. Discussion of the Background

Authorities are often involved in situations in which it is, for example, necessary to stop escaping or attacking persons with forcible measures. In these kinds of situations, it is generally necessary to use firearms and fire towards a person. A problem with traditional cartridges for firearms is that the shooter has to hit a closely defined area in a person's body in order to only injure or paralyse the person and possibly not kill him/her. Such areas in a human being comprise legs and arms, the area of which, however, is relatively small compared with the rest of the body, and they usually are in motion in a situation calling for forcible measures. Thus, high accuracy is demanded of the shooter for hitting an arm or leg.

For correcting this drawback, cartridges have been developed, which do not kill the target fired at, but only injure and paralyse the person. The U.S. patent publication 3,906,859 discloses a cartridge manufactured of one piece and consisting of soft material, which can be fired with a conventional firearm. However, this cartridge has the disadvantage that its meeting velocity is so high that one has to hit the target's legs in order to not cause a deadly injury. For securing this, the cartridge may be fired to ricochet from the ground, but in this case, it is more difficult to aim and the accuracy of the cartridge suffers.

The U.S. patent publication 3,982,489 discloses a cartridge manufactured of a circular piece, which is accurate due to its rotation speed, while the meeting velocity, however, is kept low. However, this cartridge has the drawback that a separately fixed auxiliary device is needed in the gun for firing the cartridge.

The U.S. patent publication 3,952,662 discloses a cartridge manufactured of castable material, which comprises a spherical middle section with radial ailerons extending from the said middle section. In an embodiment of this cartridge, the middle section is provided with shots as ballast. In addition, there is known a cartridge manufactured of cloth and metal shots, in which the metal shots are arranged into one or two parallel shell bags. However, the disadvantage of these cartridges is that they have a poor dimensional stability and poor frost resistance.

SUMMARY OF THE INVENTION

The object of the invention is to remove the above mentioned drawbacks and to provide a non-killing cartridge to be used as forcible means, which has better directional stability and frost resistance than previously known cartridges, and which may be fired with a conventional firearm without separate auxiliary devices.

This is achieved with a non-killing cartridge, which is characterised in that the metal shots are arranged into three or several shot bags.

The non-killing cartridge of the invention used as forcible measures has a better directional stability and frost resistance than previously known cartridges, and it may be fired with a conventional firearm without any separate auxiliary devices.

The embodiments of the invention are characterised in what is described in the following claims.

BRIEF DESCRIPTION OF THE DRAWINGS

The invention is next explained in more detail, referring to the enclosed drawings, in which.

DESCRIPTION OF THE PREFERRED EMBODIMENTS

Figure 1:
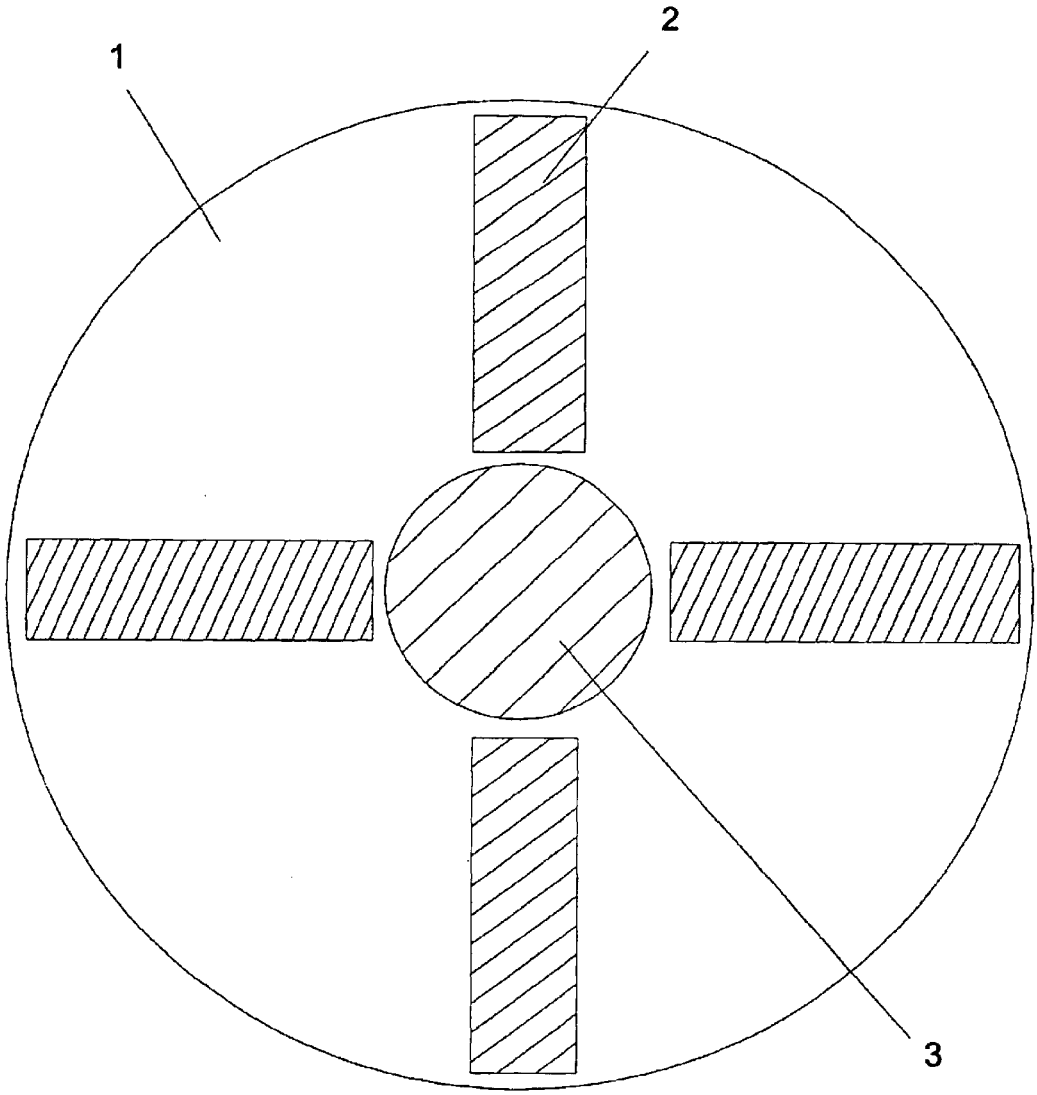
FIG. 1 shows the first embodiment of the invention opened.

The non-killing cartridge according to an advantageous embodiment of the invention in FIG. 1 comprises a circular disc 1 made of cloth, to which shot bags 2 with metal shots are made by gluing or sewing. The shot bags 2 are arranged symmetrically in relation to the centre of the disc 1. A shot bag 3 heavier than the other shot bags 2 is placed in the centre of the circle.

Figure 2:
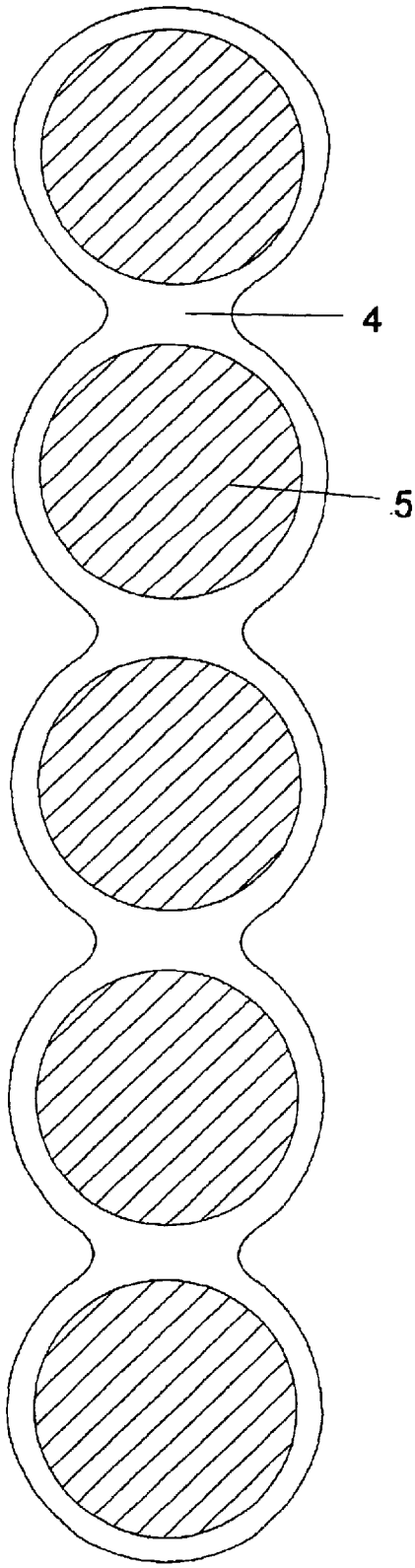
FIG. 2 shows the second embodiment of the invention opened.

The non-killing cartridge according to a second advantageous embodiment of the invention shown in FIG. 2 comprises a banded strip 4 made of cloth, to which shot bags 5 with metal shots are made by gluing or sewing. The shot bags 5 are arranged on the strip 4 at regular intervals.

Figure 3:
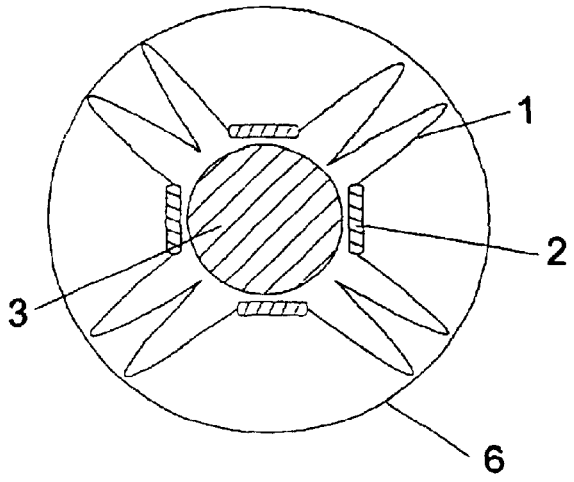
FIG. 3 is a top view of the first embodiment of the invention, packed into a shell to be used in a firearm.

FIG. 3 shows the non-killing cartridge of an advantageous embodiment of the invention, comprising the disc 1 and shot bags 2 and 3, packed into the shell 6 of a firearm.

Figure 4:
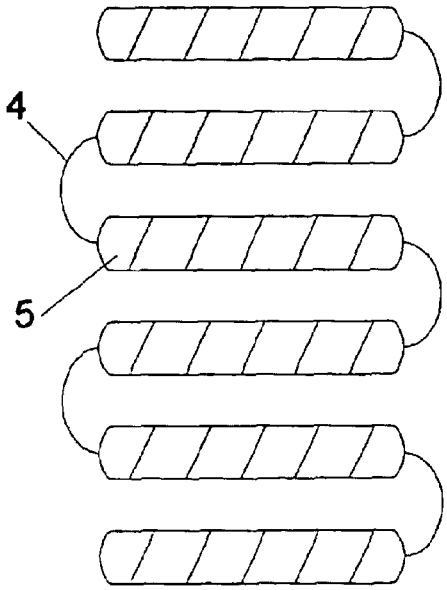
FIG. 4 shows the second embodiment of the invention, folded into a shell to be used in a firearm for packing.

In FIG. 4, there is shown the non-killing cartridge of a second advantageous embodiment of the invention, comprising the strip 4 and shot bags 5, folded in layers into the shell 6 of the firearm for packing.

Figure 5:
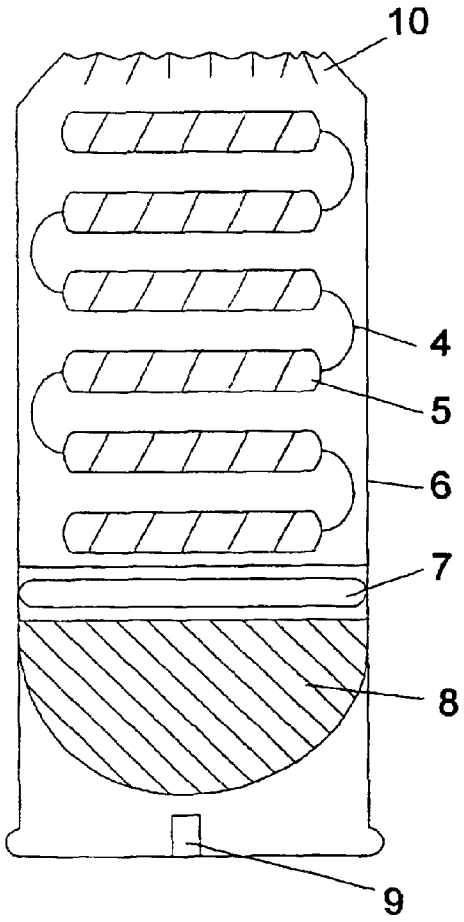
FIG. 5 shows the second embodiment of the invention, packed into a shell to be used in a firearm.

FIG. 5 shows the folded cartridge of FIG. 4, comprising the strip 4 and shot bags 5 packed into the shell 6 of the firearm, the shell comprising the intermediate plug 7, gunpowder 8, and detonating cap 9. The end 10 of the shell 6 is folded inwards for preventing the cartridge from going off unintentionally.

The cloth to be used for the manufacture of both the advantageous embodiments in FIGS. 1 and 2 has to be sufficiently strong, preferably Air-Bag cloth. The cloth used for the manufacture of the cartridge of the invention is further treated with silicone for improving the frost resistance of the cartridge. Due to this treatment, the shots are not caked together as one piece, but they keep their loose condition. Thus, the cartridge of the invention causes less damage when hitting its target.

When fired with a firearm, the cartridge of the invention first flies one metre in the packed form after leaving the barrel, and then opens to the shape shown in FIGS. 1 or 2. The flying range of the cartridge is about 50–60 metres, which may be adjusted by changing the amount of gunpowder in the shell.

When hitting the target, the area of the cartridge is sufficiently big so that no penetration occurs. Due to the large weight of the cartridge and its division into several parts, the puncturing force of the cartridge is kept low while still maintaining the percussion force. Because of its durable structure, the cartridge does not break when leaving the barrel or hitting a soft target, thus operating in the desired way, and it may be used again. When hitting a hard target, the cartridge may be damaged so that, upon reloading, the shots may become discharged.

It is obvious for one skilled in the art that the various forms of the embodiment of the invention are not limited to the examples described above, but they may vary within the scope of the following claims. The cartridge according to the second embodiment of the invention may, for example, also be folded in an overlapping manner, besides the successive folding manner shown in FIG. 4.

What is claimed is:

1. A non-killing cartridge to be fired with a firearm and packed in a shell, comprising:

a plurality of cloth shot bags connected to each other such that the plurality of cloth shot bags are configured to strike a target when the non-killing cartridge is fired; and metal shots provided in each of the plurality of cloth shot bags, wherein the cloth of the plurality of cloth shot bags is treated with silicone.

2. A non-killing cartridge to be fired with a firearm and packed in a shell, comprising:

a plurality of cloth shot bags connected to each other such that the plurality of cloth shot bags are configured to strike a target when the non-killing cartridge is fired; and metal shots provided in each of the plurality of cloth shot bags, wherein said plurality of cloth shot bags are connected by being integrally formed with a circular cloth disc.

3. A non-killing cartridge according to claim 1, wherein said plurality of cloth shot bags are connected by being integrally formed with a circular cloth disc.

4. A non-killing cartridge according to claim 2, wherein said plurality of cloth shot bags are arranged symmetrically in relation to a center of said circular cloth disc.

5. A non-killing cartridge according to claim 3, wherein said plurality of cloth shot bags are arranged symmetrically in relation to a center of said circular cloth disc.

6. A non-killing cartridge according to claim 2, wherein one cloth shot bag of said plurality of cloth shot bags is positioned at a center of said circular cloth disc, and said one cloth shot bag is a heaviest of said plurality of cloth shot bags.

7. A non-killing cartridge according to claim 3, wherein one cloth shot bag of said plurality of cloth shot bags is positioned at a center of said circular cloth disc, and said one cloth shot bag is a heaviest of said plurality of cloth shot bags.

8. A non-killing cartridge according to claim 4, wherein one cloth shot bag of said plurality of cloth shot bags is positioned at a center of said circular cloth disc, and said one cloth shot bag is a heaviest of said plurality of cloth shot bags.

9. A non-killing cartridge according to claim 5, wherein one cloth shot bag of said plurality of cloth shot bags is positioned at a center of said circular cloth disc, and said one cloth shot bag is a heaviest of said plurality of cloth shot bags.

10. A non-killing cartridge to be fired with a firearm and packed in a shell, comprising:

a plurality of cloth shot bags connected to each other; and metal shots provided in each of the plurality of cloth shot bags, wherein said plurality of cloth shot bags are connected by a linear banded strip, and wherein said plurality of cloth shot bags are arranged on the linear banded strip at regular intervals.

11. A non-killing cartridge to be fired with a firearm and packed in a shell, comprising:

a plurality of cloth shot bags connected to each other; and metal shots provided in each of the plurality of cloth shot bags, wherein the cloth of the plurality of cloth shot bags is treated with silicone, wherein said plurality of cloth shot bags are connected by a linear banded strip, and wherein said plurality of cloth shot bags are arranged on the linear banded strip at regular intervals.

12. A non-killing cartridge to be fired with a firearm and packed in a shell, comprising:

a plurality of cloth shot bags connected to each other; and metal shots provided in each of the plurality of cloth shot bags, wherein the cloth of the plurality of cloth shot bags is treated with silicone.

13. A non-killing cartridge to be fired with a firearm and packed in a shell, comprising:

a plurality of cloth shot bags connected to each other; and metal shots provided in each of the plurality of cloth shot bags, wherein said plurality of cloth shot bags are connected by being integrally formed with a circular cloth disc.

14. A non-killing cartridge according to claim 12, wherein said plurality of cloth shot bags are connected by being integrally formed with a circular cloth disc.

15. A non-killing cartridge according to claim 13, wherein said plurality of cloth shot bags are arranged symmetrically in relation to a center of said circular cloth disc.

16. A non-killing cartridge according to claim 14, wherein said plurality of cloth shot bags are arranged symmetrically in relation to a center of said circular cloth disc.

17. A non-killing cartridge according to claim 13, wherein one cloth shot bag of said plurality of cloth shot bags is positioned at a center of said circular cloth disc, and said one cloth shot bag is a heaviest of said plurality of cloth shot bags.

18. A non-killing cartridge according to claim 14, wherein one cloth shot bag of said plurality of cloth shot bags is positioned at a center of said circular cloth disc, and said one cloth shot bag is a heaviest of said plurality of cloth shot bags.

19. A non-killing cartridge according to claim 15, wherein one cloth shot bag of said plurality of cloth shot bags is positioned at a center of said circular cloth disc, and said one cloth shot bag is a heaviest of said plurality of cloth shot bags.

20. A non-killing cartridge according to claim 16, wherein one cloth shot bag of said plurality of cloth shot bags is positioned at a center of said circular cloth disc, and said one cloth shot bag is a heaviest of said plurality of cloth shot bags.

* * * * *